United States Patent [19]

Otani et al.

[11] 4,418,300

[45] Nov. 29, 1983

[54] METAL VAPOR DISCHARGE LAMP WITH HEAT INSULATOR AND STARTING AID

[75] Inventors: Katsuya Otani; Ryo Suzuki; Keiji Watanabe; Michihiro Tsuchihashi, all of Kamakura, Japan

[73] Assignee: Mitsubishi Denki Kabushiki Kaisha, Tokyo, Japan

[21] Appl. No.: 193,018

[22] Filed: Oct. 2, 1980

[30] Foreign Application Priority Data

Jan. 17, 1980 [JP] Japan ..... 55-3914
Jan. 17, 1980 [JP] Japan ..... 55-3915

[51] Int. Cl.[3] ..... H01J 61/30; H01J 61/20; H01J 61/54

[52] U.S. Cl. ..... 313/573; 313/594; 313/634; 313/642

[58] Field of Search ..... 313/225, 25, 201, 594, 313/642, 634, 573

[56] References Cited

U.S. PATENT DOCUMENTS 3,248,590 4/1966 Schmidt ..... 313/184
3,900,753 8/1975 Richardson ..... 313/225 X
4,039,880 8/1977 Beijer et al. ..... 313/225 X
4,146,813 3/1979 van Vliet ..... 313/225 X
4,253,037 2/1981 Driessen et al. ..... 313/225 X
4,314,175 2/1982 Jacobs et al. ..... 313/225 X

FOREIGN PATENT DOCUMENTS 2815014 10/1978 Fed. Rep. of Germany .
2906383 8/1979 Fed. Rep. of Germany .
2928067 1/1980 Fed. Rep. of Germany .

*Primary Examiner*—Palmer C. Demeo
*Attorney, Agent, or Firm*—Oblon, Fisher, Spivak, McClelland & Maier

[57] ABSTRACT

A metal vapor discharge lamp including an arc tube including an outer bulb and having at least an oxide crystal incorporated in the outer bulb, with a starting aid equipped on the outer circumference of said arc tube; at least one end of said arc tube having a heat insulator to keep the end warm, and a rare gas enclosed at 100 Torr or above together with at least sodium and mercury in said arc tube.

7 Claims, 12 Drawing Figures

400W HIGH PRESSURE
SODIUM LAMP
EFFICACY
150
140
130
120
EFFICACY (lm/w)
0
100
200
300
400
XENON GAS PRESSURE (Torr)

Xenon gas pressure 350 Torr
WL = 360 W
140
130
120
110
100
90
EFFICACY (lm/w)
50
100
GENERAL COLOR RENDERING INDEX (Ra)

METAL VAPOR DISCHARGE LAMP WITH HEAT INSULATOR AND STARTING AID

BACKGROUND OF THE INVENTION

1. Field of the Invention

The present invention relates to metal vapor discharge lamps such as high-pressure sodium lamps in which sodium, mercury and a rare gas are enclosed in the arc tube.

2. Description of the Prior Art

Hereafter, a high-pressure sodium lamp as an example will be described.

As shown in FIG. 1, a high-pressure sodium lamp generally consists of an electric introducer (3) made of heat-resistant metal and an electrode (6) fixed to the electric introducer (3), with said electric introducer (3) and electrode (6) fitted in cap (2) comprising alumina ceramic, etc. using a glass frit (5), said cap (2) fitted into each end of an arc tube (1) made of alumina ceramic, etc. by means of glass frit (4), and sodium, mercury, and xenon (Xe) or other rare gas at several tens of Torr used as the starting gas are sealed inside thereof. In FIG. 1, the components marked by numbers with a dash (') denote similar components to those marked with the numbers without dash. Sodium lamps having a starting aid (12) equipped over the arc tube (1) to lower the starting voltage as shown in FIG. 2 are also known well. FIG. 2 is a mount diagram for a sodium lamp having a starting aid. In this lamp easy starting is ensured: metal frame wires (7) and (8) serving as input terminals are connected and fixed, via metal wires (13) and (14), respectively to electric introducers (3) and (3') which are made of heat-resistant metal and are located at both ends of the arc tube (1) consisting of alumina ceramic, etc.; a starting aid (12) consisting of heat-resistant metal wire is laid around the outer circumference of the arc tube (1), with both ends thereof being electrically insulated and held with glass beads (9) and (10); and only at the time of starting, either input terminal (input terminal (7) in FIG. 2) is connected electrically by means of a bimetal (11), so that the distance between the two electrodes at starting can be shortened to considerably reduce the starting voltage for easy lamp starting. Members (15) and (16) in FIG. 2 are input terminals connected to said metal frame wires (7) and (8), and member (17) a stem to support said input terminals (15) and (16).

In recent years, new sodium lamps have been proposed for improved color-rendering properties in which heat-resistant metal belts (18) as shown in FIG. 2 are wrapped around the ends of the arc tube (1) as heat insulators to heighten the temperature of the coolest sections at the ends of said arc tube (1). Metal belts (18) as mentioned herein keep the coolest sections of the arc tube (1) warm, raise the sodium's vapor pressure inside the arc tube (1), enhance the sodium's resonance absorption, and have the emission spectra spread over the whole visible range, thus improving the color-rendering properties. Such warmth-keeping effect shows itself as the lamp voltage among the lamp's electrical characteristics. FIG. 3 shows the relationship between the width a of said metal belt (18) and the polential gradient E (V/cm). The potential gradient is a value obtained by dividing the lamp voltage by the arc length (electrode-to-electrode distance), and is convenient as a factor used for different arc lengths, etc. It can be seen in the figure that a potential gradient of 12 V/cm in the case without a metal belt (18) (i.e., width a=0) can be raised to about 18 V/cm by increasing the width a to 5 mm. FIG. 4 shows the relationship between the potential gradient E (V/cm) of a high-pressure sodium lamp and its general color-rendering index Ra in the case where use is made of a xenon (Xe) pressure of 20 Torr and a sodium molar ratio of 0.74. Raising the potential gradient leads to an increased Ra, and an increased tube diameter also results in an increase in the Ra value. The latter method, however, is not commonly employed because the materials of arc tubes such as polycrystalline alumina are expensive. It is, therefore, general practice to use tubes of 10 mmϕ or smaller diameter.

The color rendering properties of a high-pressure sodium lamp should be such that the Ra value is 40~70 or preferably 50~60. The reason is that Ra of 40 or below makes the lamp unsuitable as an indoor illuminating light source, while Ra of 70 or above causes a considerable reduction in the luminous efficacy. Therefore, an attempt to obtain an Ra of 40 using a tube of 8 mmϕ diameter in FIG. 4 will result in a potential gradient E of 21 V/cm. In this case, the sealed section near the tube's coolest section will be at a temperature of about 770° C., as seen from FIG. 4. To obtain an Ra of 60, which represents good color-rendering properties, a temperature of 800° C. or above will have to be encountered at the sealed section. In FIG. 5, the thickness of the sodium diffusion layer inside a sealed glass, with said sealed glass and sodium having been put in a container and allowed to stand at several different treatment temperatures for a predetermined length of time, is plotted using said treatment temperature as the variant. (Refer to "Mitsubishi Denki Giho" p. 1177, vol. 47, No. 11, 1973)

It can be seen from FIG. 5 that over 750° C. the sodium diffuses in a reacted form inside the sealed glass. Since the sealed glass treatment temperature in FIG. 5 can be regarded as equivalent to the temperature of the sealed section shown in FIG. 4, the latter temperature is required to be 750° C. or below. That is, when the temperature of the sealed section in FIG. 4 rises above 750° C., the sodium reacts with the sealed glass, which in turn renders the sealed glass brittle, thus shortening the service life of the lamp. Although the general color-rendering index Ra has a relation with the sodium molar ratio as well as with the potential gradient E and tube diameter, the relationship between the sealed section temperature and Ra shown in FIG. 4 is considered not to change considerably. That is, an attempt to obtain an Ra of 60 at 750° C. or below has obliged the use of a large, expensive arc tube of the 12 mm diameter class, as indicated in FIG. 4.

There is another method available for improving the color-rendering properties of a high-pressure sodium lamp: the vapor pressure of the sodium during lighting is raised to have the sodium itself absorb the radiation of the Na-D lines (5896 and 5890 Å) and re-radiate from different energy levels, so that the broadening of the sodium D lines can be promoted to five radiation spectra spread almost all over the whole visible range. However, since the emission spectra spread almost all over the visible range reduce the percentage of emission in the wavelength range near 555 mm with high spectral luminous efficacy, this method has the drawback that it gives lower spectral luminous efficacy than conventional high-pressure sodium lamps.

The luminous efficacy of a lamp $\eta$ (lm/W) is expressed by:

$$\eta = \eta_e K \quad (1)$$

where K (lm/W) demotes the visual luminous efficacy and $\eta_e$ the radiation efficiency of the visible region. K and $\eta_e$ are given by the following formula:

$$K = 680 \int_{380}^{780} V(\lambda) \cdot P(\lambda) d\lambda / \int_{380}^{780} P\lambda d\lambda \quad (2)$$

$$\eta_e = \int_{380}^{780} P\lambda d\lambda / w \quad (3)$$

where V ($\lambda$) denotes the spectral visual co-efficient, and P$\lambda$ the spectro-radiation energy. The value of K is about 400 lm/W in ordinary high-pressure sodium lamps, but it falls to about 330 lm/W by efforts to improve the color-rendering properties. $\eta_e$ is about 0.3, with almost no difference between the ordinary and high color-rendering types. As a whole, therefore, ordinary high-pressure sodium lamps have luminous efficacy of $\eta = 400 \times 0.3 = 120$ lm/W, but high color-rendering type lamps reduced efficacy of about $\eta = 330 \times 0.3 = 99$ lm/W. That is, although either K or $\eta_e$ or both of them can be increased to raise the efficacy $\eta$, some limitation is placed on the value of K to obtain the desired color-rendering properties, because the visual luminous efficacy K has a close connection with the sodium vapor pressure. Therefore, $\eta_e$ should be changed primarily. The visible radiation efficiency $\eta_e$ is related with the visible radiation energy transmittance of the arc tube, arc thermal conduction loss in the arc tube, and other factors. Furthermore, high-pressure sodium lamps have had the drawback that there is a considerable scattering in the drop of the starting voltage by starting aid (12), thus resulting in unfixed starting voltage.

The present invention was devised in view of the above-mentioned drawbacks.

SUMMARY OF THE INVENTION

Its primary object is, concerning metal vapor discharge tubes with heat insulators fitted to the ends of the arc tube and a starting aid provided on the outer circumference of said arc tube, to provide a metal vapor discharge lamp having good color-rendering properties by enclosing a rare gas together with sodium and mercury at 100 Torr or above in the arc tube. The secondary object of this invention is, concerning metal vapor discharge lamps arranged as above, to provide a metal vapor discharge lamp having high luminous efficacy and good color-rendering properties by fixing the ratio of the sodium weight to the total weight of the sodium and mercury P (Wt%) and the arc tube's average potential gradient E (V/cm) in such a manner that they satisfy the relationships $$10 \leqq P \leqq 90$$

and $$\frac{480}{E-6} - 30 \leqq P \leqq \frac{480}{E-12} - 20$$

wherein P is the ratio of weight of sodium and E is average potential gradient.

The third object of this invention is, concerning metal vapor discharge lamps arranged as above, to provide, by arranging the starting aid and the electrode on the arc tube's coolest side to have the same potential, a metal vapor discharge lamp in which it is possible to overcome the electric field shielding effect of the sodium-mercury amalgam and other substances enclosed in the lamp that are formed in the arc tube's inner surface near the electrode at the tube's coolest section as well as the diffusion of the lines of electric force (reduction of the density of the line of the electric force), and in which the starting voltage is low with a low degree of scattering.

DETAILED DESCRIPTION OF THE PREFERRED EMBODIMENT

Figure 6:
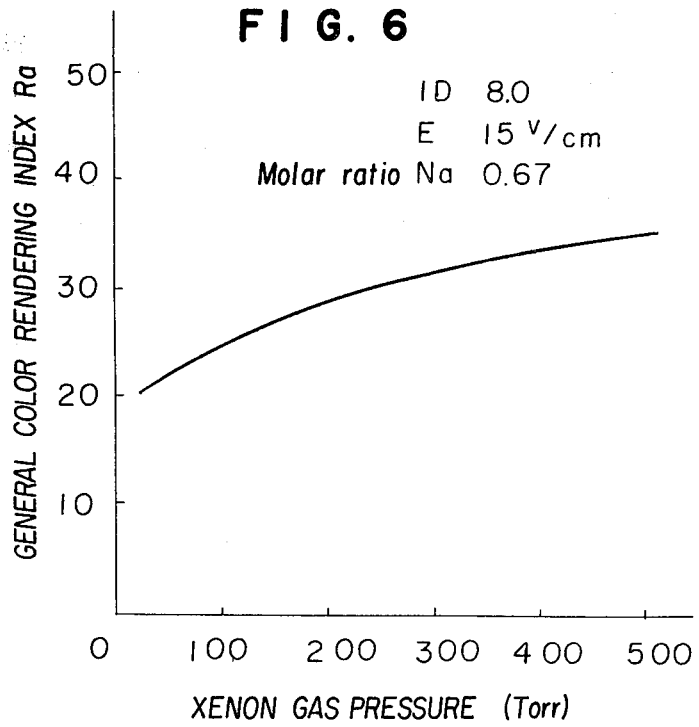
FIG. 6 shows the effect of the xenon (Xe) pressure on the general color-rendering index Ra.

FIG. 6 shows changes of Ra when the xenon (Xe) pressure is changed with the potential gradient, the tube's internal diameter, and sodium molar ratio kept constant. It is seen from the figure that Ra increases with a rise in the Xenon pressure. This is because the xenon (Xe) atoms have a certain effect on the probability of the sodium atom's or molecule's resonance absorption in the arc or in the vapor layer surrounding it.

The present inventors have invented a metal vapor discharge lamp with raised xenon (Xe) pressure of the type equipped with metal belts (18) serving as heat insulators at both ends of the arc tube (1), by applying the abovementioned effect of xenon (Xe) pressure on Ra. The results are given by the broken lines in FIG. 4. When a xenon (Xe) pressure of 300 Torr is used, an Ra of 60 can be achieved at the critical temperature 750° C. of the sealed section while keeping the diameter of the arc tube (1) at 8 mm, as seen in the figure. When a larger tube diameter is employed, Ra becomes still higher at the same sealed section temperature, as in the case where the xenon (Xe) pressure is low. It can be seen in FIG. 6 that the use of a xenon pressure of 100 Torr or above is required. In addition, since increasing the xenon (Xe) pressure causes a rise in the starting voltage to start the arc tube (1), this invention employs a starting voltage over the outer circumference of the arc tube (1).

EXAMPLE 1

Figure 1:
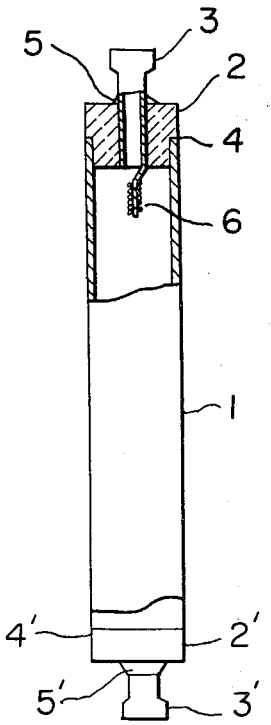
FIG. 1 is a front view showing an ordinary high-pressure sodium lamp arc tube.
Figure 2:
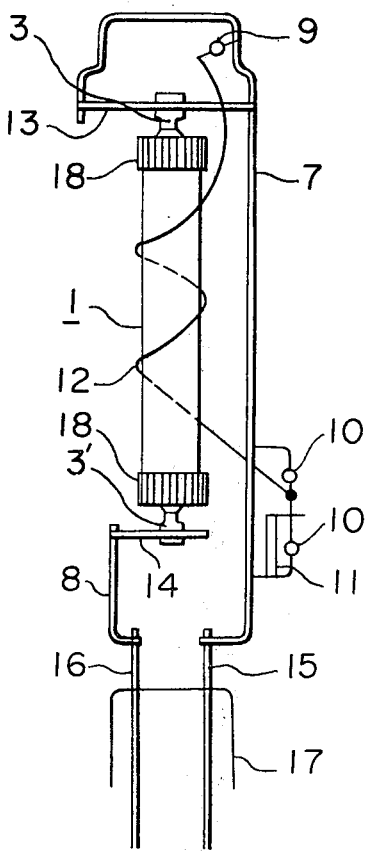
FIG. 2 is a front view showing an arrangement in which the arc tube of a high-pressure sodium lamp equipped with a starting aid is mounted.
Figure 3:
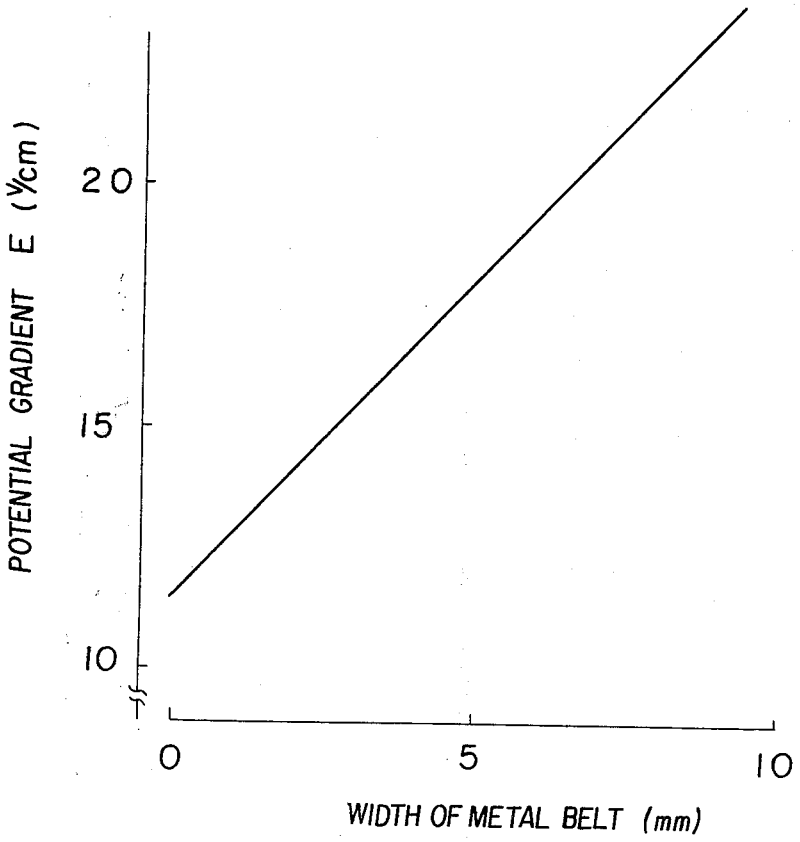
FIG. 3 shows the relationship between the width of the metal belt as a heat insulator and the potential gradient.

A lamp was maufactured by way of trial which has a lamp structure as shown in FIG. 2, incorporates a bimetallic starter in its outer bulb, and has an arc tube (1) inner diameter of 8.0 mm, an electrode-to-electrode disdance of 7.9 cm, an enclosed sodium-amalgam ratio of 0.81, and xenon (Xe) enclosing pressure of 350 Torr. Data with this lamp are listed in the following table (Table 1).

TABLE 1

| | |
|---|---|
| Lamp voltage | 130 V |
| Lamp current | 3.3 A |
| Lamp power | 360 W |
| Luminous efficacy | 120 lm/W |
| Ra | 60 |
| Color temperature | 2150K |

As mentioned above, this invention is to achieve high color-rendering properties by sealing higher pressure of xenon (Xe) gas in the arc tube (1) in a high-pressure sodium lamp having metal belts (18) as heat insulators fitted to the ends of the arc tube and a starting aid provided over the outer circumference of said arc tube (1). It offers such advantage that the lamp can be produced at low cost. The rare gas sealed in the arc tube (1) is not limited to xenon (Xe); any mixture of xenon (Xe) with several other gases, kyrypton (Kr) or any other gas having an effect similar to that of xenon (Xe) may be used.

The arc tube used in the above description had a diameter of 8.0 mm. However, the arc tubes thicker than, or thinner than, 8.0 mm can also be used, so long as they allow the utilization of the effect that a rise in the xenon (Xe) or other rare gas pressure contributes to better color rendition. Tube diameters of 5 mm ~ 12 mm are generally preferred. Arc tubes with small diameters will be applicable particularly in high-pressure sodium lamps of small power. Although the above description of the present invention cited a high-pressure sodium lamp, it is needless to say that this invention can also be applied to metal halide lamps and other metal vapor discharge lamps, provided that sodium is enclosed with the use of a arc tube consisting of polycrystalline alumina or other oxide crystals.

In the above description a metal belt was cited as the heat insulator, but ceramic or other materials may also be used if they can successfully keep the ends of the arc tube warm. Also, said heat insulator can be fitted to only one end of the arc tube. When sodium-mercury amalgam is enclosed, the sodium's amalgam molar ratio $\rho$ should preferably be $0.1 \leqq \rho \leqq 1.0$. This is because the use of a $\rho$ of less than 0.1 ($\rho < 0.1$) brings about a drop in the sodium ratio which, in turn, causes large changes in the lamp voltage due to sodium loss and thus causes light dying. Potential gradient E is determined from the relationship between the tube diameter and the tube wall load. Tube wall load $W_L$ is given by the following formula:

$$\omega_L = \frac{W_L}{\pi D l_a} \ (W/\mathrm{cm}^2) \tag{1}$$

where $W_L$ denotes the tube electric power, D denotes the tube diameter, and la the electrode-to-electrode distance. The $\omega_L$ should preferably be used at 20 $W/cm^2$ or below in the case of polycrystalline alumina. Hence, since the potential gradient E is given by $$E = \frac{V_L}{l_a} \ (\mathrm{V/cm}) \tag{2}$$

(where $V_L$ denotes the lamp voltage), the following relation holds:

$$E \leqq \frac{20\pi D V_L}{W_L} \tag{3}$$

In the case of D=0.8 cm, $V_L$=130 V and $W_L$=360, E will be equal to, or smaller than, 18.15 ($E \leqq 18.15$). Formula (3) gives the upper limit of the potential gradient E.

Figure 4:
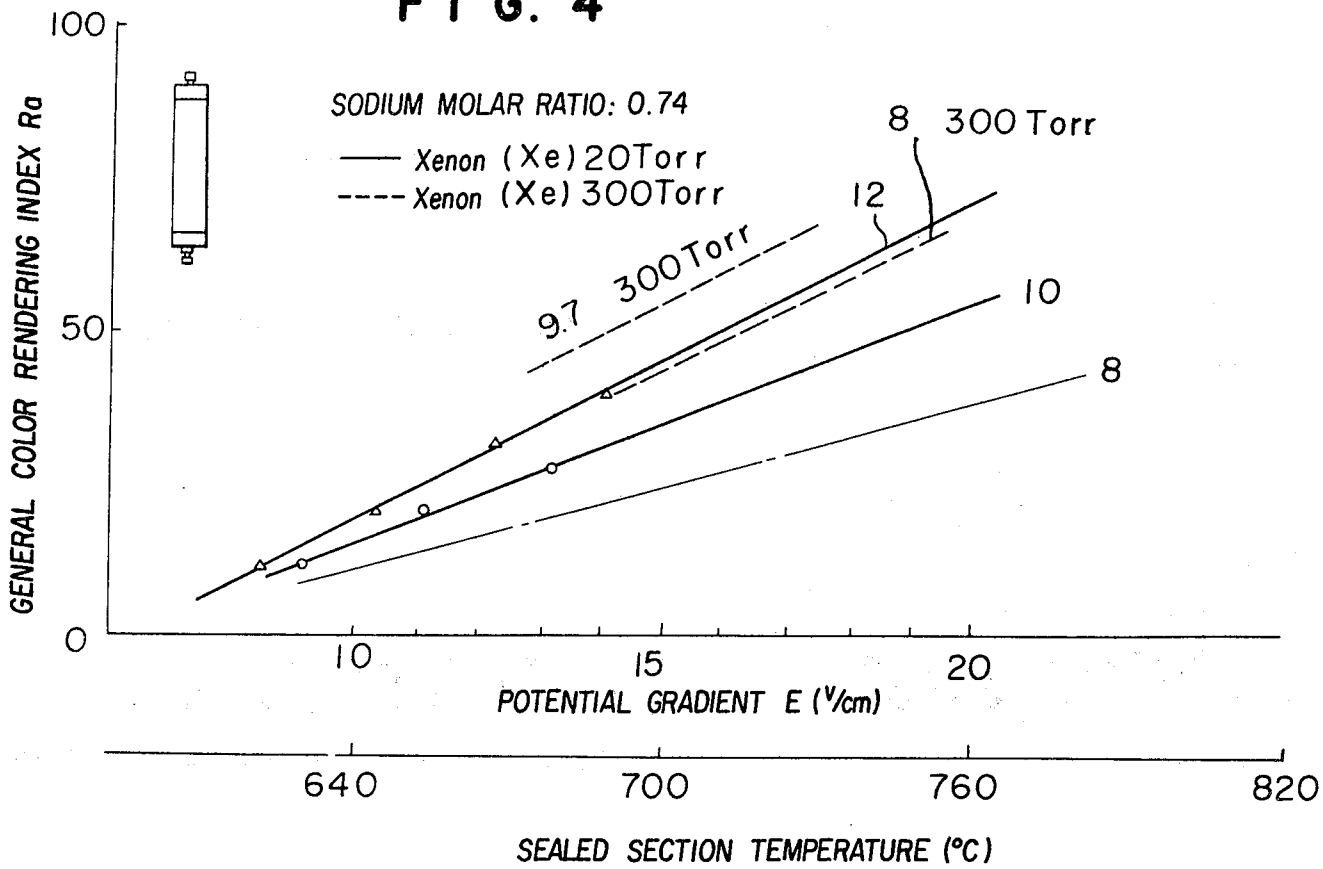
FIG. 4 shows the relationship between the potential gradient or sealed section temperature and the general color-rendering index Ra.
Figure 5:
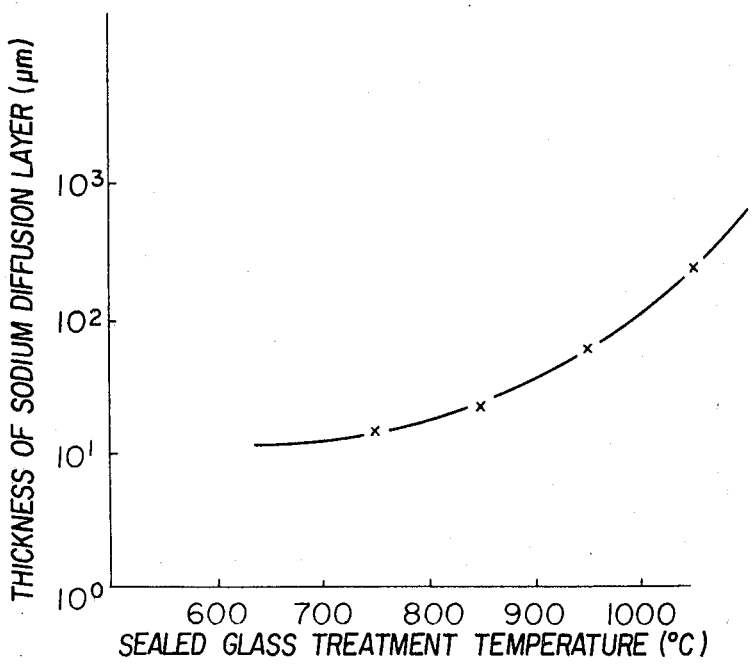
FIG. 5 shows the relationship between the sealed glass treatment temperature and the width of the sodium diffusion layer.

The xenon (Xe) pressure, which was cited above as 100 Torr or higher, should preferably be 200 Torr or above, as can be seen from FIG. 4, and 500 Torr or below for reasons related to the starting voltage.

Width a of the metal belt, on which a description was made in the above test, should preferably be $0 < a \leqq 15$ mm. The reason is that when a is larger than 15 mm ($a > 15$ mm), the sealed section will have a temperature of 800° C. or higher, shortening the lamp's service life considerably.

Figure 7:
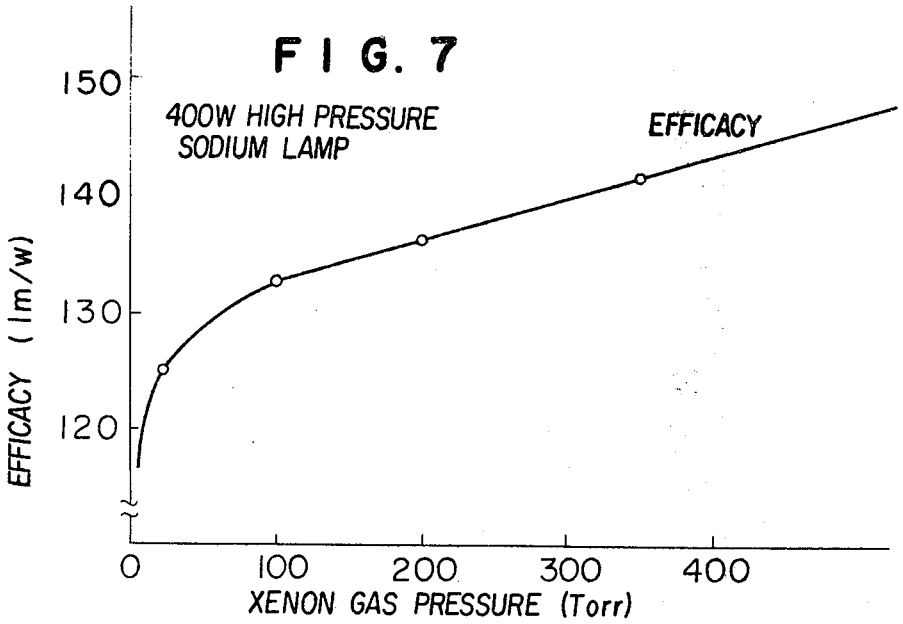
FIG. 7 shows the relationship between the xenon pressure and the luminous efficiency.

FIG. 7 shows the relationship between the xenon gas pressure and the luminous efficacy in an example where xenon is used as the enclosed gas. It is seen that an increase in the xenon gas pressure contributes to a rise in the efficacy. The xenon gas pressure should preferably be set to 100 Torr or above. Visible radiation efficiency $\eta_e$ can be raised from 0.3 to about 0.36 by setting the xenon gas pressure to 400 Torr. As a result, the efficacy will be $$330 \times 0.36 = 119 \text{ lm/W}.$$

Figure 8:
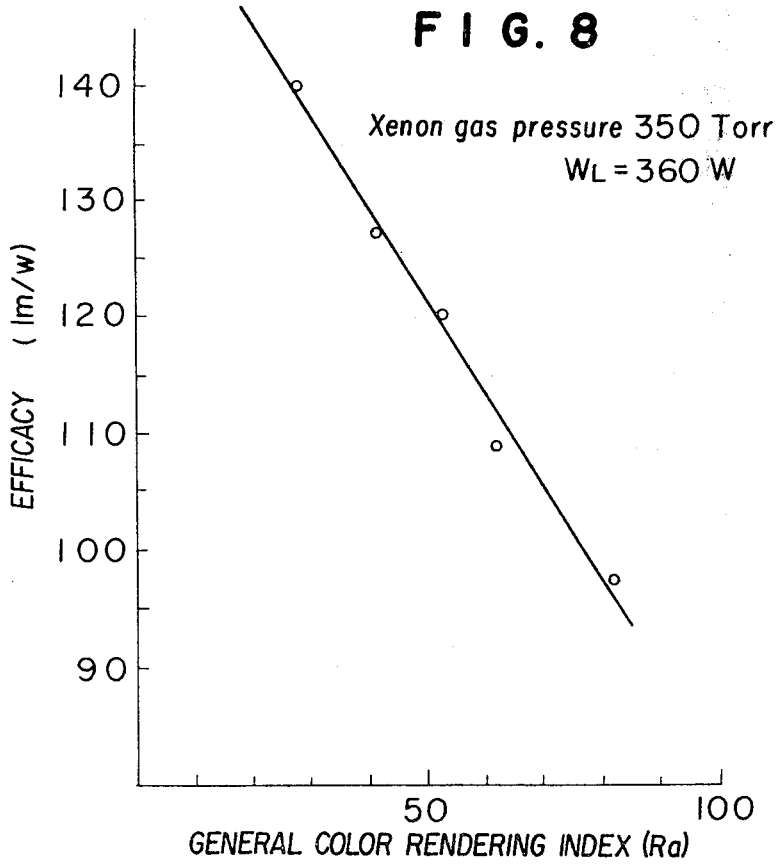
FIG. 8 shows the relationship between the general color-rendering index and the luminous efficacy.

The inventors also studied the color-rendering properties, searching for proper values of general color-rendering index Ra. These efforts enabled the inventors to find that the Ra value should be changed from the 20 ~ 30 for conventional high-pressure sodium lamps to 40 ~ 70. A study on the relation between the color-rendering properties and the luminous efficacy led to the results as shown in FIG. 8. In the example of FIG. 8, measurements were carried out using a xenon gas pressure of 350 Torr and a constant lamp power of 360 W, with general color-rendering index Ra plotted on the abscissa and lamp efficacy on the ordinate. It can be seen from FIG. 8 that an attempt to raise Ra will reduce the efficacy and an attempt to raise the efficacy will reduce Ra. The luminous efficacy required for a high-pressure sodium lamp is generally said to be 110 lm/W or higher. The reason is that since existing metal halide and other lamps of a high color-rendering type can offer efficacy of about 100 lm/W, high-pressure sodium lamps will have no special advantage if they have efficacy of 110 lm/W or below. Because of this, the upper limit of Ra is required to be restricted to Ra = 60 ~ 70 or around. As for the lower limit of Ra, the inventors studied high-pressure sodium lamps with Ra of 40 or above, since conventional high-pressure sodium lamps have color-rendering properties of Ra=30 or so. That is, the high-pressure sodium lamps meant by the present inventors in this invention have efficacy lf 110 lm/W or above and the general color-rendering index Ra in a range of $40 \leqq Ra \leqq 70$.

As mentioned above, 110 lm/W or higher efficacy could be achieved by raising the xenon gas pressure to 100 Torr or above. A general color-rendering index Ra, on the other hand, has a connection with the ratio of sodium-mercury enclosed and the potential gradient of the arc.

Figure 9:
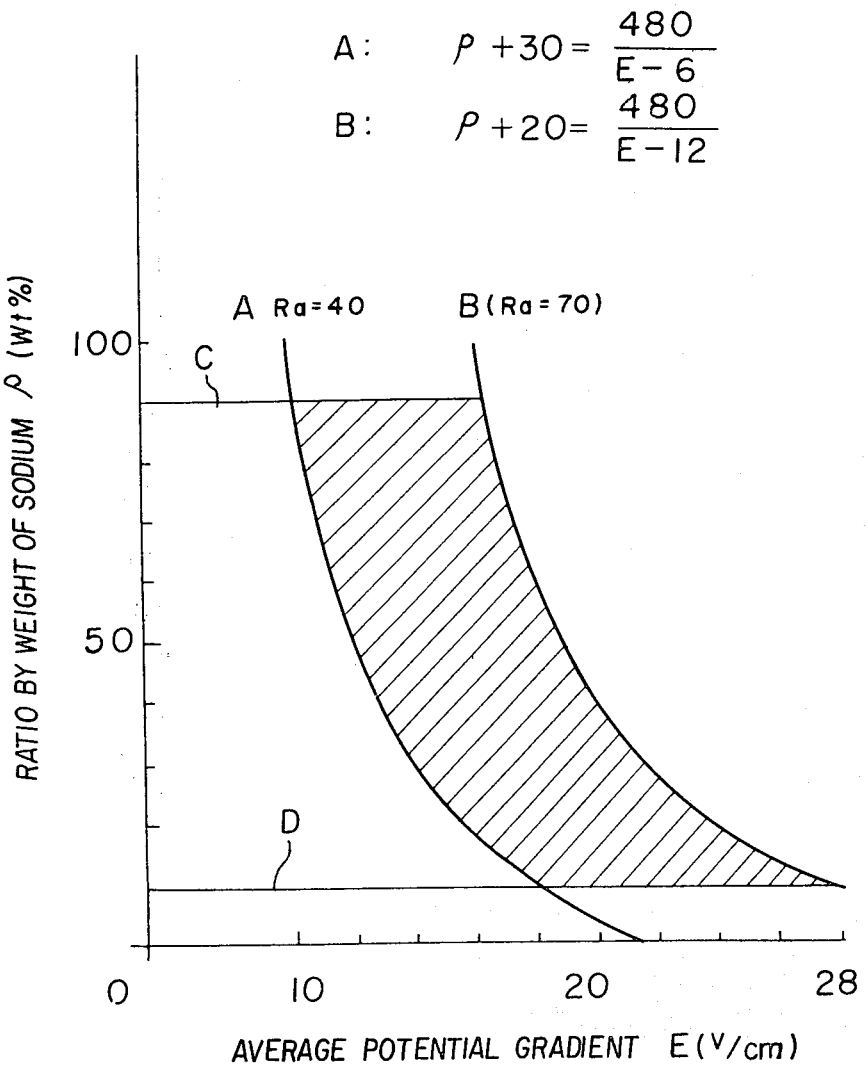
FIG. 9 shows the relationship between the average potential gradient and the sodium weight ratio.

FIG. 9 shows the relationship between the ratio by weight of the sodium to the total sodium-mercury amalgam (wt%) and the average potential gradient (V/cm). Of the two curves A and B, curve A represents the relation between the sodium wieght ratio and the average potential gradient giving an Ra of 40. Having the two factors on curve A enables a lamp of Ra=40 to be achieved. Likewise, curve B represents the relation by which Ra=70 is achieved. The sodium weight ratio and potential gradient in the region between curve A and curve B give Ra of 40~70. When the sodium weight ratio exceeds 90 wt%, however, it is difficult to achieve a predetermined lamp voltage. This means that the temperature of the arc tube's coolest section, a factor to decide the lamp voltage, has to be made as highest as possible, and that the temperature of the arc tube's sealed section near the coolest section must be raised, with a disadvantageous effect on the lamp's service life. On the other hand, a sodium weight ratio of less than 10 wt% will allow the impurities in the lamp to have a larger effect. That is, since the sodium reacts with the impurities during operation of lamp, the reduced amount of sodium will lead to larger mercury effect, resulting in a sharp rise in the lamp voltage and light dying. For this reason, the sodium weight ratio should be selected within a range of 10~90 wt%. Accordingly, it is concluded that sodium lamps of Ra=40~70 can be achieved by determining the sodium weight ratio and average potential gradient to assume values in the shaded region defined by curves A and B and straight lines C and D in FIG. 9. Curve A and curve B are respectively expressed by the following formulae, with $\rho$ (wt%) standing for the sodium weight ratio and E (V/cm) for the average potential gradient:

$$A: \rho + 30 = \frac{480}{E - 6} \quad (4)$$

$$B: \rho + 20 \frac{480}{E - 12} \quad (5)$$

Considering these formulae together with the relation $10 \leqq \rho \leqq 90$ gives the following formulae:

$$\frac{480}{E - 12} - 30 \leqq \rho \leqq \frac{480}{E - 12} - 20 \quad (6)$$

$$10 \leqq \rho \leqq 90 \quad (7)$$

From formulae (6) and (7), the average potential gradient range is determined as follows:

$$10 \leqq E \leqq 28 \quad (8)$$

That is, it is possible, as mentioned above, to achieve a high-quality high-pressure sodium lamp having high efficacy and good color-rendering properties of Ra=40~70, with high industrial advantages, by using a sealed gas pressure of 100 Torr or higher and fixing sodium weight ratio $\rho$ (wt%) and the lamp's average potential gradient E (V/cm) within the range defined by formulae (6) and (7).

Although use was made of xenon gas in the description of this invention, krypton, argon or other gas, or a gas mixture with xenon gas can also be employed. In any case, the use of 100 Torr or higher pressure accompanies a rise in the efficacy, but xenon gas gives the highest rate of efficacy rise. This is considered to be attributed to the small thermal conductivity of xenon gas. Also, though use was made of a rare gas and sodium-mercury as the substances sealed in the lamp in the above description of this invention, other metals may be added together with the sodium-mercury to improve the color temperature and other characteristics to such an extent that no serious change in the potential gradient can be caused by such an addition.

EXAMPLE 2

An arc tube with an arc length of 6.2 cm was produced by way of trial using an arc tube of 114 mm in length and 8.0 mm in inner diameter, and arranging electrodes on both ends, for use with NH-360LX changeable mercury-arc lamp stabilizer, and xenon gas 400 Torr at room temperature and sodium-mercury amalgam pellets with a sodium weight ratio of 17 wt% were enclosed in the tube. When it was operated using a stabilizer for the 400 W mercury-arc lamp, luminous efficacy of 120 lm/W, general color-rendering index Ra of 60, and a color temperature of 2200° K. were obtained at a lamp voltage of 125 V (potential gradient: 20.2 V/cm) and lamp power of 360 W.

Figure 10:
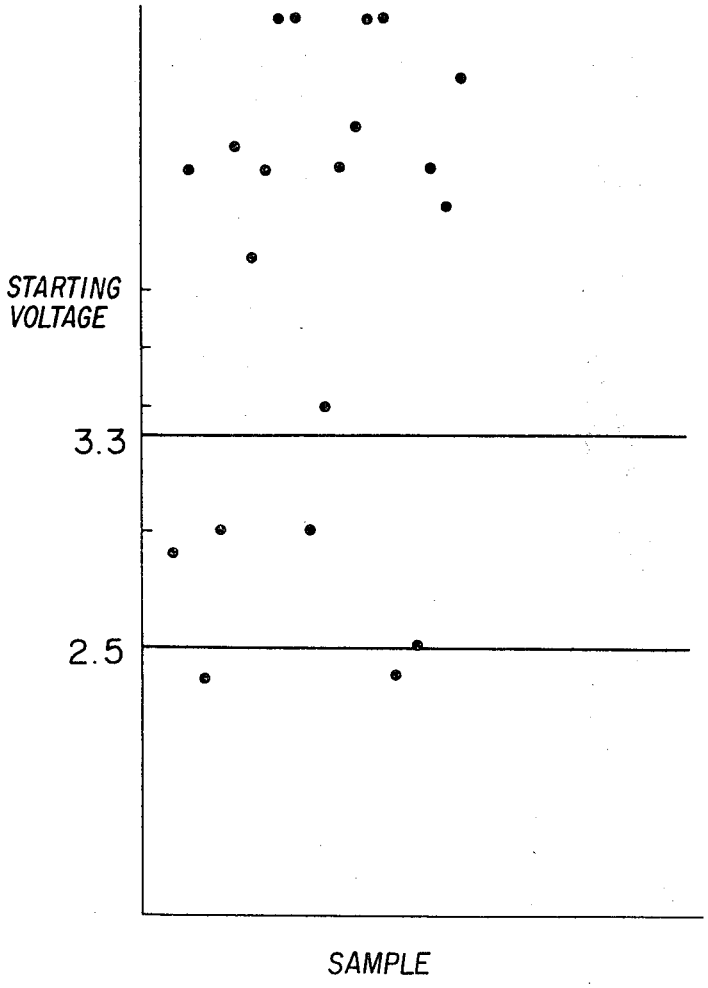
FIG. 10 shows a scatter in the starting voltage of the high-pressure sodium lamp shown in FIG. 2.

FIG. 10 shows the respective starting voltage measured on 20 400 W high-pressure sodium lamps which were prepared by setting the enclosed xenon pressure of 350 Torr in high-pressure sodium lamps shown in FIG. 2. It is seen in this figure that the starting voltages are scattered considerably.

The inventors made detailed research on the above-mentioned scattering of the starting voltage, and found that the main cause of the scattering is connected with blackening of the internal surfaee of the arc tube near its electrode (6). It was also made clear that since said black substance almost disappears during the lamps' operation, much of it is formed by the adhesion of the Na-Hg amalgam, the substance sealed in the lamp, to the arc tube's internal surface near electrode (6), in addition to blackening caused by the spattering of electrode emission material, and that such blackening as caused by the Na-Hg amalgam occurs particularly on the side ends of the arc tube's coolest section. That is, it is considered that on going out of the light, the Na and Hg vapors condense at the side ends of the arc tube's coolest section which are easier to cool, and adhere to the arc tube's inner surface near the electrode (6) which forms a surface to be easily trapped by scattering electronic radiations, etc.

Figure 11:
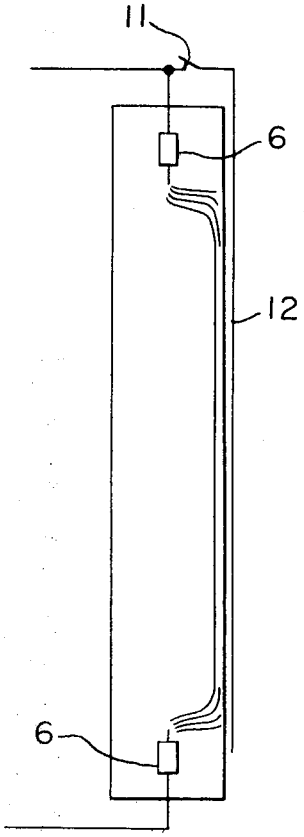
FIGS. 11(a) and (b) illustrate the lines of electric force at the starting of a high-pressure sodium lamp.
Figure 11:
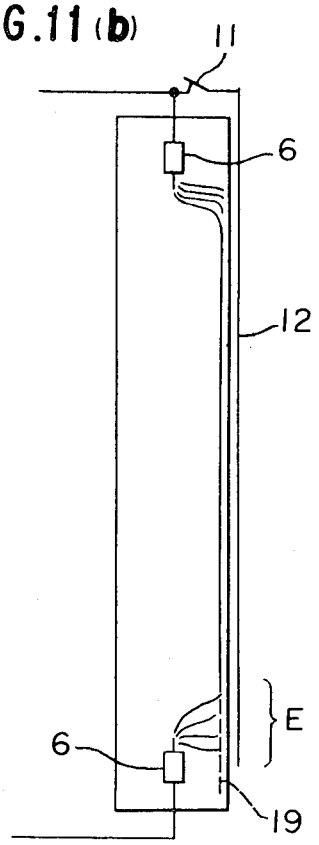

The relation between the blackening of the arc tube's inner surface near electrode (6) and the starting voltage can be considered as follows. That is, the lines of electric force at the time of starting inside the arc tube of a high-pressure sodium lamp equipped with a starting aid (12) as shown in FIG. 2 are considered to be as shown in FIGS. 11(a) and (b). Here, FIG. 11(a) shows lines of electric force in the case with no blackening on the arc tube's inner surface near electrode (6). In this case, starting is easy because the lines of electric force at the time of starting concentrate via starting aid (12), thus contributing to a large density of the lines of electric force. When blackening occurs on the arc tube's inner surface near the electrode (6), however, the lines of electric force are as shown in FIG. 11(b), resulting in a rise in the starting voltage. That is, the lines of electric force widen, as shown in part E of the figure, due to black substance (19) adhered to the arc tube's inner surface near the electrode (6) that forms a film of high electric conductivity, and accordingly the density of the lines of electric force becomes small. The result is that starting aid (12) can have only small, unreliable effects of lowering the starting voltage, with a rise or scattering in the value of starting voltage.

Figure 12:
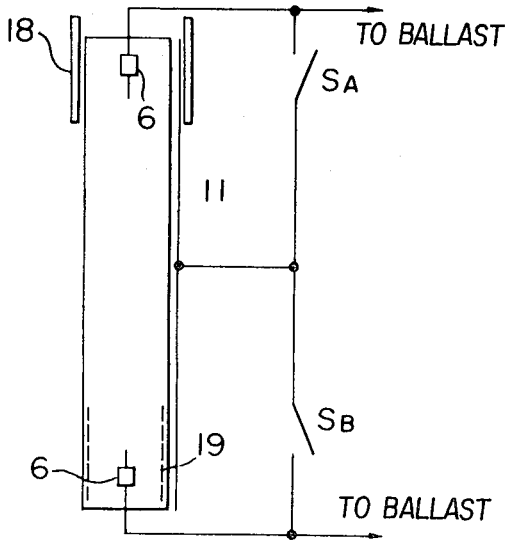
FIG. 12 shows the main part of a starting circuit used in an experiment to obtain a metal vapor discharge lamp in accordance with present invention.

The present inventors, in view of the above fact, carried out the following experiment. That is, a heat insulator (18) consisting of a metal belt as shown in FIG. 12 was fitted to one end of the arc tube of a 400 W high-pressure sodium lamp with a xenon pressure of 350 Torr; starting aid (12) was provided over the outer circumference of the arc tube, as shown in FIG. 2, with the arc tube's coolest section coming to the end opposite to the above-mentioned end; and provision was made that said starting aid (12) could be electrically connected to the respective input terminals of the non-coolest and the coolest sides, by means of switches $S_A$ and $S_B$, as shown in the figure. With this arrangement, switch $S_A$ and switch $S_B$ were closed alternatively and respective starting voltage was measured. The data obtained are listed in the following Table 2.

TABLE 2

| Condition | No. of experiments 1 | 2 | 3 | 4 | 5 | Average |
|---|---|---|---|---|---|---|
| $S_A$ on, $S_B$ off | 3.0 | 3.2 | 3.0 | 3.5 | 3.2 | 3.2 |
| $S_A$ off, $S_B$ on | 5.0 | 5.2 | 5.5 | 6.0 | 6.0 | 5.5 |
| | | | (Unit: KV) | | | |

It can be seen from Table 2 that the starting voltage becomes large when starting aid (12) and the arc tube's coolest section have the different potentials.

Therefore, if the potential of starting aid (12) and that the electrode (6) in the arc tube's coolest section are made equal, it will become possible to overcome the electric-field shielding effect and the dispersion of the lines of electric force (fall of the density of the lines of electric force) caused by the Na-Hg amalgam and other substances enclosed in the lamp that are formed on the arc tube's internal surface near electrode (6) in the coolest section, and accordingly to prevent rises in the starting voltage and thereby provide metal vapor discharge lamps of low starting voltage with no scattering in it.

Although an example of a high-pressure sodium lamp was used in the above description for the embodiment example, it is needless to say that the present invention can be applied to other metal vapor discharge lamps using a starting aid (12).

We claim:

1. A metal vapor discharge lamp which comprises:
an arc tube made of at least an oxide crystal,
a starting aid equipped on the other circumference of said arc tube;
one end of said arc tube having a heat insulator to keep the end warm, and a rare gas enclosed at a pressure range of 200 Torr to 500 Torr together with at least sodium and mercury in said arc tube wherein the inner diameter of said arc tube is in the range of 5 mm to 12 mm, with the amalgam ratio of said sodium being in the range of 0.1 to 1.0, average potential gradient E of the lamp at lighting being $E \leqq (20\pi DVL/WL)$ (V/cm) (where D denotes the inner diameter of the tube (cm), $V_L$ denotes the lamp voltages, and $W_L$ the lamp power); and
a metal belt being used as said heat insulator, said metal belt having a width of a $0 < a \leqq 15$ mm.

2. A metal vapor discharge lamp as claimed in claim 1, wherein the rare gas enclosed in said arc tube is xenon.

3. A metal vapor discharge lamp as recited in claim 1, wherein the rare gas enclosed in said arc tube is a mixture of xenon and another gas.

4. A metal vapor discharge lamp which comprises:
an arc tube made of at least an oxide crystal,
a starting aid equipped on the outer circumference of said arc tube;
one end of said arc tube having a heat insulator to keep the end warm;
a rare gas enclosed at a pressure range of 200 Torr to 500 Torr together with at least sodium and mercury in said arc tube and
said arc tube having an inner diameter in the range of 5 mm to 12 mm, wherein the ratio of the weight of the sodium and the mercury $\rho$ (wt%) and average potential gradient of the arc tube E (V/cm) are so selected as to satisfy formulae of relationship $10 \leqq \rho \leqq 90$ and $$\frac{480}{E-6} - 30 \leqq \rho \leqq \frac{480}{E-12} - 20.$$

5. A metal vapor discharge lamp as claimed in claim 4, wherein xenon is used as the rare gas enclosed in said arc tube.

6. A metal vapor discharge lamp which comprises:
an arc tube having opposed ends and made of at least an oxide crystal;
a starting aid equipped on the outer circumference of said arc tube;
one end of said arc tube having a heat insulator to keep said one end warm, wherein the opposed end of the arc tube represents the coolest side thereof; and
a rare gas enclosed at 100 Torr or above together with at least sodium and mercury in said arc tube, wherein said starting aid and an electrode at the coolest side of the arc tube are so arranged to have the same potential.

7. A metal vapor discharge lamp as claimed in claim 6, wherein xenon is used as the rare gas enclosed in said arc tube.

* * * * *